US005988685A

United States Patent [19]

Mogelonsky et al.

[11] Patent Number: 5,988,685

[45] **Date of Patent: *Nov. 23, 1999**

[54] MULTIPLE FACED CUSTOMIZABLE FOLIO SYSTEM

[75] Inventors: Larry Leibe Mogelonsky, Toronto; Douglas G. Schwartz, Montreal, both of Canada

[73] Assignee: Post-Fax Inc., Montreal, Canada

[ * ] Notice: This patent is subject to a terminal disclaimer.

[21] Appl. No.: 08/910,416

[22] Filed: Aug. 13, 1997

Related U.S. Application Data

[60] Provisional application No. 60/028,288, Oct. 18, 1996.

[51] Int. Cl.[6] ..... B42D 3/00; B42D 1/00; B42F 13/00

[52] U.S. Cl. ..... 281/31; 402/79; 402/80; 402/3; 281/38; 281/29; 229/71

[58] Field of Search ..... 229/67.1, 72; 281/46, 281/37, 34; 283/117, 15.1, 81, 63.1, 100, 101; 402/75, 71, 73, 25, 502

[56] References Cited

U.S. PATENT DOCUMENTS

| | | | |
|---|---|---|---|
| 237,061 | 1/1881 | Sneider . | |
| 315,425 | 10/1885 | Harvey | 150/52 |
| 456,717 | 7/1891 | Brodix . | |
| 752,537 | 2/1904 | Eneas . | |
| 868,758 | 10/1907 | Bexell . | |
| 970,399 | 9/1910 | Sawyer . | |
| 1,054,522 | 2/1913 | Exline . | |
| 1,065,414 | 6/1913 | Wiesner . | |
| 1,157,810 | 10/1915 | Seelman, Jr. . | |
| 1,201,802 | 10/1916 | Cass . | |
| 1,447,731 | 3/1923 | Pouher . | |
| 1,509,158 | 9/1924 | Love, Jr. . | |
| 1,634,064 | 6/1927 | Ahlquist . | |
| 2,246,397 | 6/1941 | Traum | 281/17 |
| 2,390,864 | 12/1945 | Bayley | 229/72 |
| 3,038,742 | 6/1962 | Leap | 281/29 |
| 3,078,107 | 2/1963 | Loderhose | 281/29 |
| 3,310,321 | 3/1967 | Freund | 281/31 |
| 3,516,599 | 6/1970 | Buttery | 229/72 |
| 4,301,962 | 11/1981 | Monckton et al. | 229/72 |
| 4,306,737 | 12/1981 | Errichiello | 281/32 |
| 4,420,112 | 12/1983 | Cline | 229/72 |
| 4,629,349 | 12/1986 | Pitts | 402/74 |
| 4,640,413 | 2/1987 | Kaplan et al. | 206/232 |
| 4,819,962 | 4/1989 | Takai | 281/15.1 |
| 4,832,369 | 5/1989 | Johnson et al. | 281/18 |
| 4,848,798 | 7/1989 | Moor | 281/31 |
| 4,863,093 | 9/1989 | DuCorday | 229/1.5 R |
| 4,934,584 | 6/1990 | Wyant | 229/1.5 R |

(List continued on next page.)

OTHER PUBLICATIONS

Meriam Webster's Collegiate Dictionary, 10th edition, p. 1141, col. 1, line 25, 1997.

*Primary Examiner*—Willmon Fridie, Jr.
*Assistant Examiner*—Alisa L. Thurston
*Attorney, Agent, or Firm*—Virginia H. Meyer, Esq.; Mark J. Spolyar, Esq.

[57] ABSTRACT

The present invention provides a new customizable folio or report cover system that is useful for presenting customized optical characteristics to both the outer and inner faces of a folio cover. The customized optical characteristics are presented at the outer and inner faces of the folio cover as the result of selective replacement of insert sheet(s) that are placed into a pocket formed between the outer and inner faces of the folio cover. The outer and inner faces of the folio cover each have at least one cutout section(s), of any desired shape or design, through which selective part(s) of the replacement sheet(s) can be viewed. The insert sheet(s) have optical characteristic(s) that are different from those of the outer and inner faces of the folio cover, at least in those areas of the insert sheet that can be seen through the cutout section(s). The different optical characteristics may include content, graphics, pictures, color and/or texture, any of which may be printed on, or added to, the insert sheet by the folio user, using any suitable imaging or attachment method.

21 Claims, 12 Drawing Sheets

U.S. PATENT DOCUMENTS

| | | | |
|---|---|---|---|
| 4,958,855 | 9/1990 | Shipp | 281/45 |
| 4,971,361 | 11/1990 | Whiting | 281/2 |
| 4,991,767 | 2/1991 | Wyant | 229/1.5 R |
| 5,020,828 | 6/1991 | Moor | 281/29 |
| 5,025,978 | 6/1991 | Pacione | 229/1.5 |
| 5,090,732 | 2/1992 | Kuhns et al. | 281/29 |
| 5,114,009 | 5/1992 | Johnston | 40/159 |
| 5,120,090 | 6/1992 | Reinl | 283/117 |
| 5,141,485 | 8/1992 | Welt | 493/210 |
| 5,284,362 | 2/1994 | Kachel et al. | 281/45 |
| 5,330,281 | 7/1994 | Kalan | 281/15.1 |
| 5,405,473 | 4/1995 | Kuhns | 156/226 |
| 5,411,201 | 5/1995 | Petkovsek | 229/71 |
| 5,445,417 | 8/1995 | Bromer et al. | 281/46 |
| 5,447,333 | 9/1995 | Kuhns et al. | 281/29 |
| 5,598,969 | 2/1997 | Ong | 229/67.1 |
| 5,752,721 | 5/1998 | Balbas | 281/19.1 |
| 5,882,038 | 3/1999 | Ong | 281/31 |

MULTIPLE FACED CUSTOMIZABLE FOLIO SYSTEM

RELATED APPLICATION

This application claims the benefit of U.S. Provisional Application Ser. No. 60/028,288 filed Oct. 18, 1996.

BACKGROUND OF THE INVENTION

1. Field of the Invention

The present invention relates to folio and report cover systems. More particularly, the present invention relates to a new customizable cover system for presenting different optical characteristics to both the inner and outer faces of a folio or report cover.

2. Description of the Prior Art

The use of folio and report covers of different designs and configurations is well known in the art. For example, a number of different folio and report cover designs can be found in any stationary store or catalog.

One known folio design is described in U.S. Pat. No. 4,991,767 to Wyant, who discloses a portfolio with photograph displaying cover. While the Wyant design allows several photographs to be viewed through the portfolio cover, it requires that individual pockets be formed in the portfolio cover, to hold the photographs. In the Wyant design, the placement of the pockets is dictated by the manufacturer of the portfolio. As such, the Wyant design limits the ability of the portfolio user to customize the portfolio cover.

Another design known in the art is the LaserSlide™ report and cover system by PostFax™ office and school products. The LaserSlide™ is a customizable cover system for presenting different optical characteristics to the outer face of a folio or report cover that has cutout section(s) therein, and a backing sheet of substantially the same size attached thereto. The different optical characteristics are present on, or added to, an insert sheet that is inserted into a pocket formed between the backing sheet and the outer face of the cover. These different optical characteristics can then be viewed through the cutout section(s) in the outer face of the folio cover. While the LaserSlide™ cover system is customizable, it is limited to presenting different optical characteristics at one face of the folio cover.

While the covers of the prior art fulfill their respective objectives and requirements, the prior art covers do not include or suggest a customizable folio or report cover system for presenting different optical characteristics to both the inner and outer faces of a folio or report cover through selective replacement of insert sheet(s) that are inserted into a pocket between the outer face of the cover and an inner backing sheet, for viewing through cutout sections in both the inner backing sheet and the outer face of the folio cover. In this respect, the customizable cover system according to the present invention represents a substantial improvement over the concepts and covers of the prior art, and in doing so provides a novel cover primarily developed for the purpose of presenting customizable optical characteristics to the both inner and outer faces of a folio cover through selective replacement of insert sheets. Further, the present invention gives the user more display options and an enhanced "custom" look over the prior art designs. The present invention also allows the display of user defined content on both sides of a folio cover with the use of one or more insert sheets. Therefore, it can be appreciated that a need exists for a new customizable report or folio system that can be used for presenting customized optical characteristics to both the inner and outer face of a folio cover through selective replacement of insert sheet(s). In this regard, the present invention substantially fulfills this need.

SUMMARY OF THE INVENTION

The present invention provides a new customizable folio or report cover system that can be used for presenting selectable and customizable optical characteristics to both the outer face of the folio cover, and the inner face, which is sometimes referred to herein as the folio cover backing sheet, or the inner backing sheet. The folio or report cover of the invention may be made of any suitable pliable material, such as paper, paperboard, plastic, fabric, leather and the like. (As used herein, "folio" is used synonymously with folder, report, or binder, etc., and "folio system" is used synonymously with folder system, report system, or binder system, etc.) According to the invention, the customized optical characteristics are presented at the inner and outer faces of a folio cover by selective replacement of insert sheet(s) that are placed into a pocket formed between the outer cover sheet of the folio cover and an inner backing sheet. According to the teaching of the invention, there is at least one cutout section(s), of any desired shape or design, in both the outer cover sheet and an inner backing sheet of the folio cover through which selective part(s) of an insert sheet(s) can be viewed. The insert sheet(s) have optical characteristic(s) that are different from those of the inner and outer faces of the folio cover, at least in those areas of the insert sheet(s) that can be seen through the cutout section(s). The selectable and different optical characteristics may include color and/or texture. They may also include printing and/or designs that are added to the insert sheet(s) by the folio user, using any suitable imaging method. Suitable methods include, but are not limited to, laser or ink jet printers, typewriters, photocopiers, and "by hand". In addition, the different optical characteristics may further include textured, pictorial and/or graphical material such as photographs or business cards that are attached to the insert sheet(s) by the folio user, by any suitable method. Suitable methods include affixing the photographs or business cards to the insert sheet(s) with adhesive, or by means of slits cut into the insert sheet(s).

More specifically, the present invention is a folio cover system comprised of at least one folio cover, and selected insert sheet(s) for insertion into a pocket that is formed within at least one of the folio cover(s). The insert sheet(s) may be supplied by the folio manufacturer as part of the folio system, or may be supplied by the folio user.

At least one of the folio cover(s) is comprised of an outer cover sheet that has at least one cutout section therein, and at least one inner backing sheet that similarly has at least one cutout section therein. An inner backing sheet(s) is affixed or otherwise secured to the outer cover sheet by any suitable means so as to form a pocket between the outer cover sheet and the inner backing sheet. In preferred form, the inner backing sheet is substantially the same size as the outer cover sheet. In alternative embodiments, the inner backing sheet may be smaller than the outer cover sheet. For example, the inner backing sheet may have vertical edges that possess one half of the length of the vertical edges of the outer cover sheet. The folio may be square, but preferably is rectangular in shape, with short upper and lower edges, and longer lateral sides. In one preferred form, an inner backing sheet is secured to the outer front cover sheet at the lower and side edges, leaving the upper edge as the open edge of the pocket. In another embodiment first and second inner backing sheets are similarly secured to the outer front cover sheet, resulting in a cover sheet with two separate pockets for the receipt of insert sheets or other materials.

In addition to the folio cover(s), the system of the invention includes insert sheet(s) for use with the folio cover system. The insert sheet(s) is preferably substantially the same shape as a pocket between the outer cover sheet and an inner backing sheet, but just slightly smaller in size to facilitate its insertion into the pocket. The insert sheet(s) will have at least one optical characteristic that is different from the folio's outer cover sheet and/or an inner backing sheet in the area(s) that will be visible through the cutout section(s) of the outer folio cover and an inner backing sheet, when the insert sheet(s) is in place in the selected pocket between a backing sheet and the outer cover sheet. (As used herein, different optical characteristic(s) mean differences that are visible and perceptible by the human eye.) Such different optical characteristic(s) may include content, e.g., text, graphics, pictures, as well as color and/or texture. When the different optical characteristics are color and/or texture, they are preferably preprinted on the insert sheet(s). Content, such as text, graphics, and pictures are preferably added to the insert sheet(s) by the folio user. After the insert sheet(s) is placed in a pocket between the folio's outer cover sheet and an inner backing sheet, the different optical characteristic(s) are visible through the cutout section(s) in the outer cover sheet and the backing sheet. For example, if the different optical characteristic(s) include color, the color will be visible through the cutout section(s). As indicated above, the different optical characteristic(s) can also include content or other "custom" material that is added by the folio user, thereby giving the folio a "custom" look as designed and dictated by the folio user.

In preferred form, a single insert sheet will be used to impart different optical characteristics to both the inner backing sheet and the outer folio cover sheet in the area(s) corresponding to the cutout sections therein. This can be accomplished by having different optical characteristics on, or added to, both sides of the insert sheet, at least in those areas of the insert sheet that will be visible through the cutout sections of the inner backing sheet and outer folio cover sheet. This can also be accomplished by having different optical characteristics on, or added to, different areas of the insert sheet, such that, when the insert sheet is folded and inserted into a pocket between the outer front cover and the inner backing sheet, certain characteristics are visible through the cutout section(s) of the inner backing sheet, and others are visible through the cutout section(s) in the outer folio cover. In alternate form, two inserts sheets can be inserted into the selected pocket between the outer front cover and the inner backing sheet, "back to back", so that certain characteristics are visible through the cutout section (s) of the inner backing sheet, and others are visible through the cutout section(s) in the outer folio cover.

By way of example and according to one teaching of the invention, the outer front cover of the folio may have at least one cutout "window" section that is large enough to accommodate desired content, such as title(s), textual material, and/or graphic(s). In addition to the window section(s) there may be additional cutout sections that are smaller in size and form a design in the cover. These smaller cutout sections might be arrays of small squares, circles, diamonds, triangles, diagonals or the like. Further, the inner backing sheet (or inner front cover) will have at least one cutout window section, that may for example, be large enough to accommodate desired content, e.g., graphic or textual material. In this configuration, the insert sheet will have at least one optical characteristic, e.g., content, and/or color and/or texture and/or graphics of a first type, on one side corresponding to the area(s) that will be visible through the window(s) of the outer face of the front cover, and another optical characteristic(s) in the area of the design element cutout(s) of the outer front cover. The side of the insert sheet facing towards the inner or backing side of the folio cover may similarly have optical characteristic(s) of a third type in the area of the window of the inner face of the front folio cover. The folio user can print or add desired content, such as title, text and/or graphics, on both sides of an insert sheet in the area of the windows by any suitable means. Suitable printing means include laser or ink jet printers, typewriters, photocopiers, or by hand. When the insert sheet is placed in the pocket between the outer front folio cover sheet and the backing sheet, the first optical characteristic will be visible through the window in the outer cover sheet of the folio cover, while the second optical characteristic will be visible through the design cutouts. Similarly, the third optical characteristic will be visible through the cutout window in the backing sheet. As a result, and in this example, the folio cover will have a custom look, and three tones on the outer face: the tone of the cover, the tone of the window, and the tone of the design cutouts. Additionally, the inner face of the front cover (which is also referred to as the front cover backing sheet) will also have a custom look: the tone of the cover and the tone of the window. This custom, multiple tone effect on the outer and inner faces of the front cover is achieved easily and inexpensively with the folio, the pre-colored insert sheet, and custom material added by the folio user, using any suitable means.

Again by way of example and according to another teaching of the invention, the inner backing sheet, and the resultant pocket between the inner backing sheet and the outer front cover sheet, will not be as large as the outer front cover, and both the outer front cover sheet and the inner backing sheet of the folio will each have at least one cutout "window" section therein that is large enough to accommodate desired content. In this configuration, a single "folded" insert sheet will be used to add the desired optical characteristics to the folio. To accomplish this, the unfolded insert sheet will have at least one optical characteristic printed on, or added to, a portion of the sheet that will be visible through the window(s) of the outer face of the front cover when the folded insert sheet is in place in the pocket between the outer front cover sheet and the inner backing sheet. The other optical characteristics will be printed on, or added to, another portion of the insert sheet that will be visible through the window(s) of the inner backing sheet when the folded insert sheet is in place in the pocket. As a result, and in this example, the folio cover will have a custom look.

In yet another preferred embodiment, the insert sheet includes means for attaching textual, pictorial and/or graphic material(s) thereto. More specifically, the system may include a folio and an insert sheet both of which are adapted for the display of material(s) such as business card(s) and/or photograph(s). In use, the user attaches the desired materials, such as business card(s) or photograph(s), etc., to the insert sheet and then positions the insert sheet into the pocket created by the outer front cover sheet and the inner front cover backing sheet. The outer front cover sheet includes cutout opening(s) corresponding to the locations of the attached material(s) and other printed content on the insert sheet such that the attached material(s) are visible through the cutout openings in the folio cover. Additionally, the backing sheet includes a cutout through which the insert sheet and any materials added or attached thereto are visible.

The more important features of the invention have thus been outlined, rather broadly, so that the detailed description thereof that follows may be better understood, and in order that the present contribution to the art may be better appreciated. Additional features of the invention will be described below.

In this respect, before explaining preferred embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

OBJECTS OF THE INVENTION

It is an object of the present invention is to provide a new folio cover system for presenting selected optical characteristics to both the inner and outer faces of a folio cover through selective replacement of insert sheet(s).

It is another object of the present invention is to provide a new folio cover system for presenting selected optical characteristics to both the inner and outer faces of a folio cover, which can easily be customized by the folio user.

Yet another object of the present invention is to provide a new folio system for presenting different optical characteristics, including textual, pictorial, and/or graphical materials to both the inner and outer faces of a folio cover through selective replacement of insert sheet(s).

Yet another object of the present invention to provide a new folio cover system that may be easily and efficiently manufactured and marketed.

It is a further object of the present invention to provide a new folio cover system that is of durable and reliable construction.

An even further object of the present invention is to provide a new folio cover system that is susceptible of a low cost of manufacture with regard to both materials and labor, and which accordingly is then susceptible of low prices of sale to the consuming public, thereby making such a folio system economically available to the buying public.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1A is a plan view of a first preferred embodiment of the present invention in a spread orientation; FIG. 1B is a plan view of a first preferred embodiment of the present invention in an open orientation; and, FIG. 1C is a front view of a first preferred embodiment of the folio system constructed in accordance with the principles of the present invention.

FIG. 2A is a cross-sectional view as taken along line 2A—2A of FIG. 1C; FIG. 2B is a cross-sectional view as taken along line 2B—2B of FIG. 1C; and, FIG. 2C is a cross-sectional view as taken along line 2C—2C of FIG. 1C.

FIG. 3A is a front view of an insert sheet for use in the present invention as depicted in FIGS. 1A–1C; and, FIG. 3B is a back view of an insert sheet (or front view of a second insert sheet) for use in the present invention as depicted in FIGS. 1A–1C.

FIG. 4A is a plan view of a second preferred embodiment of the present invention in a spread orientation; FIG. 4B is a front view of an insert sheet of the second preferred embodiment after it has been folded along its vertical fold line, which is shown here at center; FIG. 4C is a plan view of a second preferred embodiment of the present invention in an open orientation; and, FIG. 4D is a front view of a second preferred embodiment of the folio system constructed in accordance with the principles of the present invention.

FIG. 5A is a plan view of a third preferred embodiment of the folio system of the present invention in an open orientation; and, FIG. 5B is a plan view of a third preferred embodiment of the present invention in a spread orientation.

FIG. 6A is a plan view of the back cover of a fourth preferred embodiment in a spread orientation; FIG. 6B is a plan view of the back cover, showing the pocket therein; and, FIG. 6C is a plan view of the front cover of a fourth preferred embodiment in a spread orientation.

FIG. 9A is a front view of an insert sheet of a sixth preferred embodiment; and, FIG. 9B is a plan view of a sixth preferred embodiment in an open configuration.

FIG. 11A is a plan view of the front cover of a seventh preferred embodiment of the present invention in a spread orientation; FIG. 11*b* is a front view of insert sheets of a seventh preferred embodiments; and, FIG. 11C is a front view of the front cover constructed in accordance with the principles of the present invention.

FIG. 12A is a plan view of an eighth preferred embodiment of the present invention in a spread orientation; and, FIG. 12B is a plan view of an eighth preferred embodiment of the present invention in an open orientation.

FIG. 13A is a plan view of a ninth preferred embodiment of the present invention in a spread orientation; FIG. 13B is a plan view of an ninth preferred embodiment of the present invention in an open orientation; FIG. 13C is a front view of the folio system with the front cover flap in an open orientation; and, FIG. 13D is a front view of the ninth preferred embodiment constructed in accordance with the principles of the present invention.

The same reference numerals refer to the same parts throughout the various Figures.

DESCRIPTION OF A FIRST PREFERRED EMBODIMENT

With reference now to the drawings, and in particular, to FIGS. 1A–3B thereof, a first preferred embodiment of the new folio cover system embodying the principles and concepts of the present invention and generally designated by the reference number 10 will be described.

Specifically, it will be noted in the various Figures that the invention relates to a customizable folio system for presenting different optical characteristics to both the inner and outer faces of a front folio cover through selective replacement of insert sheet(s). In its broadest context, the invention comprises a folio front cover having at least one cutout section therein, a front cover backing sheet also having at least one cutout section therein, and at least one insert sheet. The insert sheet(s) can be provided with the front folio cover, or can be provided separately. Such components are individually configured and correlated with respect to each other so as to attain the desired objective.

Figure 1A:
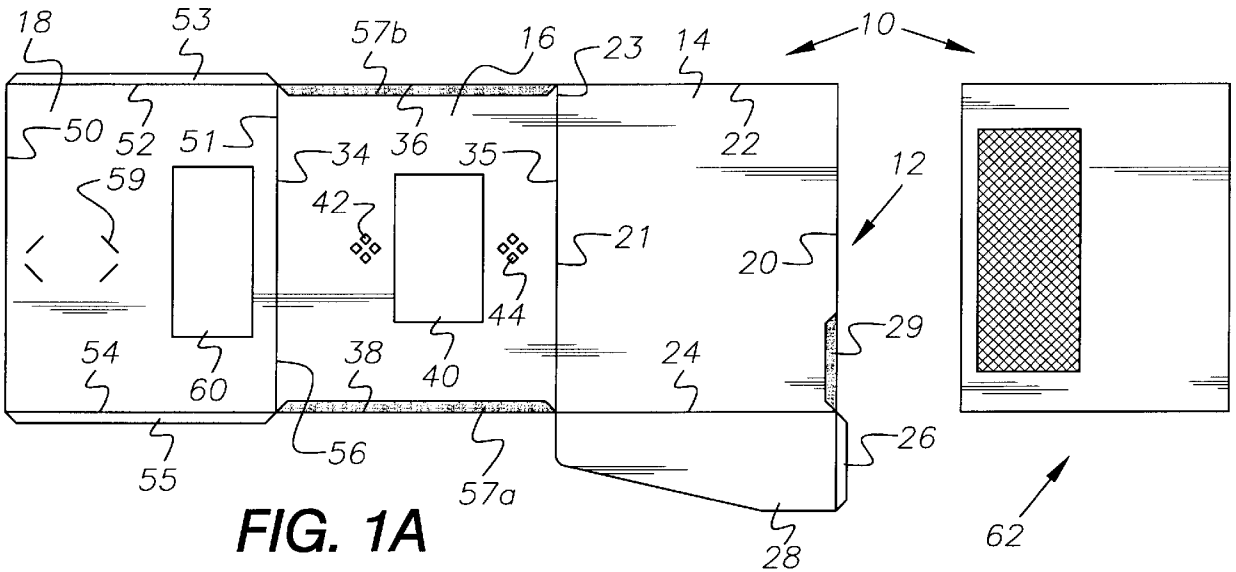
FIGS. 1A, 1B, and 1C.
Figure 1B:
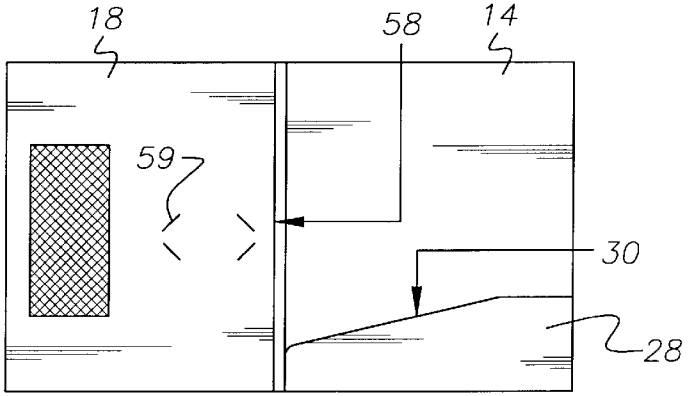
Figure 1C:
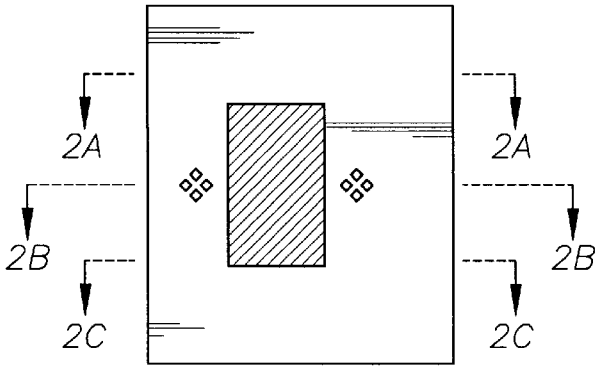
Figure 2A:
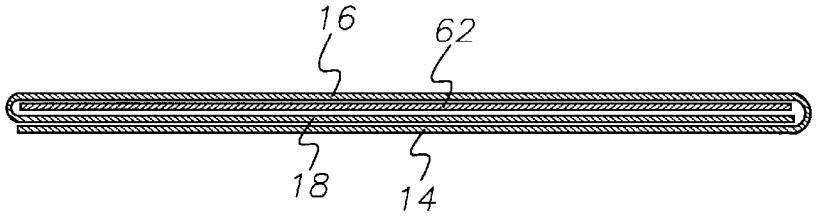
FIGS. 2A, 2B, and 2C.
Figure 2B:
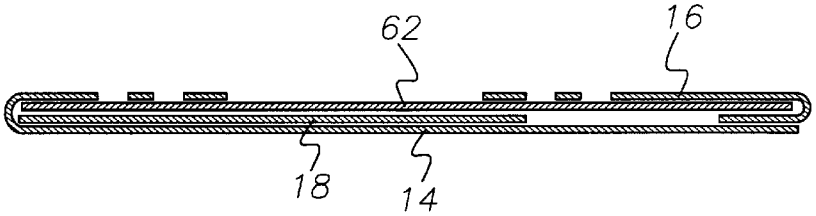
Figure 2C:
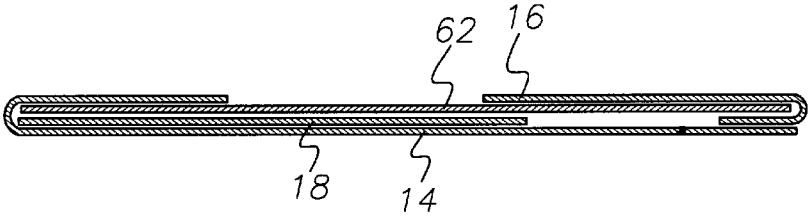

More specifically, in the first preferred embodiment the present invention is a system 10, as shown in FIGS. 1A–1C. System 10 has a folio 12, as shown in FIGS. 1A–1C. The folio is preferably rectangular in configuration, and in a first preferred embodiment is formed of a first rear or back cover sheet 14, a second outer front cover sheet 16 and a third front cover backing sheet 18. Back cover sheet 14 has long vertical side edges 20 and 21. In this preferred form it also has a short upper edge 22 and a short lower edge 24. Back cover sheet 14 may have a short bottom flap 28 that extends downwardly from bottom edge 24. Short bottom flap 28 may have one short laterally disposed flap 26. Short bottom flap 28 is adapted to be folded upwardly to cover a portion of the back cover sheet. Short lateral flap 26 is adapted to be folded under. Preferably there is adhesive 29 that couples together short lateral flap 26 and back cover sheet 14 to form a pocket 30 for the receipt of supplemental materials. Alternatively, but not shown, the pouch pocket may be formed of a lateral flap adapted to be folded inwardly so as to be in contact with the inner face of the back cover sheet.

Next provided in system 10 of this embodiment is the folio's second sheet, namely outer front cover sheet 16. Outer front cover sheet 16 is also preferably in a rectangular configuration. Outer front cover sheet 16 has two long vertical side edges, 34 and 35. Outer front cover sheet 16 may be formed separately from back cover sheet 14, but in preferred form is formed integrally with it. Specifically, vertical long edge 35 of outer front cover sheet 16 is formed integrally with long vertical edge 21 of back cover sheet 14 of the folio, along a first common joining or vertical fold line 23. Outer front cover sheet 16 further has a short upper edge 36 and a short lower edge 38. Outer front cover sheet 16 has at least one cutout opening therein, which in this embodiment is shown as a large rectangular window opening 40. Such an opening may be located in the central extent of outer front cover sheet 16. Outer front cover sheet 16 still further preferably has an array of small cutout design openings 42, 44 to the left and right of large window opening 40.

Next provided in this embodiment is the third folio sheet, namely the inner front cover backing sheet 18. Inner front cover backing sheet 18 is also preferably in a rectangular configuration. Inner front cover backing sheet may be formed separately from outer front cover 16, but in a preferred style, is formed integrally with it. Inner front cover backing sheet 18 has at least one cutout opening therein, which in this embodiment is shown as a rectangular window opening 60. Inner front cover backing sheet 18 has long side edges 50 and 51. It also has a short upper edge 52 and a short lower edge 54. Long edge 51 of inner front cover backing sheet 18 is preferably formed integrally with long vertical edge 34 of outer front cover sheet 16 at a second common joining or vertical fold line 56. Inner front cover backing sheet 18 may have a top flap 53 extending along upper edge 52, and a bottom flap 55 extending downwardly from bottom edge 54. In this embodiment, top flap 53 is folded down, bottom flap 55 is folded up, and inner front backing sheet 18 is folded over and made to be in contact with outer front cover sheet 16. Preferably there is adhesive 57*a* and 57*b* along the upper edge of the front cover backing sheet and along the lower edge of the front cover backing sheet to thereby form a pocket 58 with an open lateral edge between the outer front cover sheet and the front cover backing sheet. Pocket 58 is shown in FIG. 1B.

Front cover backing sheet 18, or short bottom flap 28 may have means for securing a business card or other material thereto. In FIG. 1B the securing means is shown as four slits 59, into which a business card can be placed. Still further, and not shown, the securing means may be a pocket formed by a slit opening in inner front cover 18 into which a brochure or other material(s) is placed (not shown).

Figures 3A, 3B:
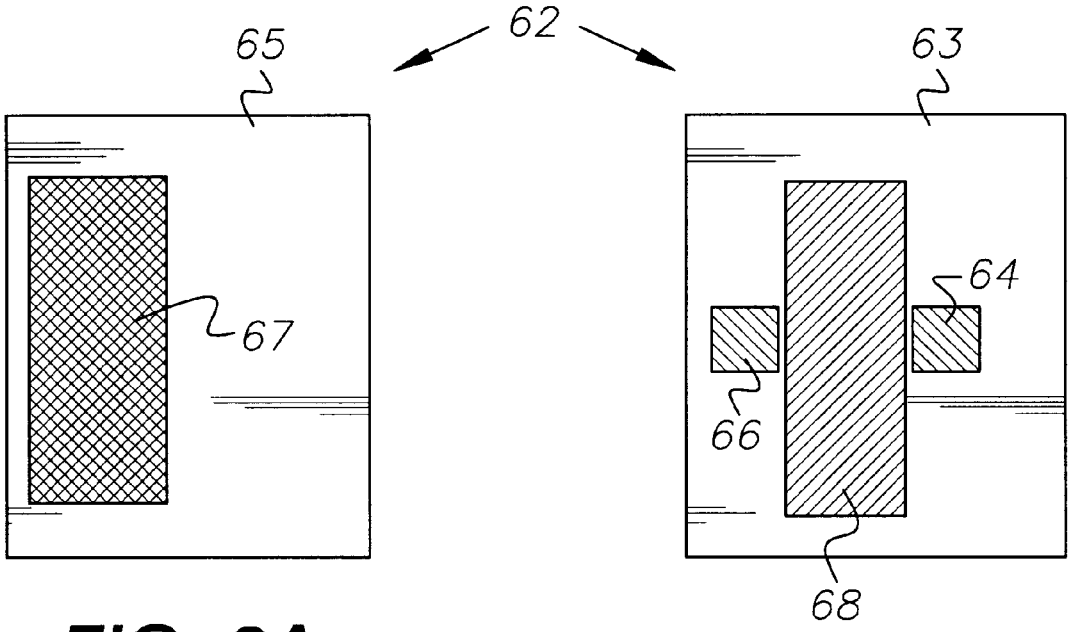
FIGS. 3A and 3B.

As shown in FIGS. 3A and 3B, lastly provided in system 10 is an insert sheet 62. Such insert sheet is positionable within pocket 58. The insert sheet(s) may be provided with the folio, or may be provided separately. As shown in FIG. 3A, the first face 65 of insert sheet 62 has a region 67 of an optical characteristic positionable behind cutout window 60 of the front cover backing sheet 18. As shown in FIG. 3B, the second face 63 of insert sheet 62 preferably has a first lateral region 66 of a first optical characteristic positionable behind cutout design openings 42 to the left of large window opening 40. It further preferably has a second lateral region 64 of an optical characteristic positionable behind cutout design openings 44 to the right of large window opening 40. Insert sheet 62 still further preferably has a central region 68 of another optical characteristic that may be different from lateral regions 64 and 66 for being viewed through large window opening 40. The optical characteristics of insert 62 allow folio 12 to take on different visual looks. The preferable fabrication of insert 62 is a sheet of laser printable paper with different optical characteristics on opposing sides of the sheet. The optical characteristics on insert 62 can include, but are not limited to, color, texture, printing and graphics. Insert 62 is placed within pocket 58 between outer front cover sheet 16 and front cover backing sheet 18 with the optical characteristics aligned with the openings in outer front cover sheet 16 to allow the optical characteristics on the insert sheet to be viewed through the cutout openings in the folio cover and backing sheet. If desired, insert 62 may include adhesive means (not shown), for example in the area of the upper corners, for securing insert sheet 62 to the inner face of front cover 16.

DESCRIPTION OF A SECOND PREFERRED EMBODIMENT

In a second preferred embodiment customized content can be added to both the inner and outer faces of a "flap" that folds over the closed folio. This form of the invention is shown in FIGS. 4A thru 4D.

Figures 4A, 4B:
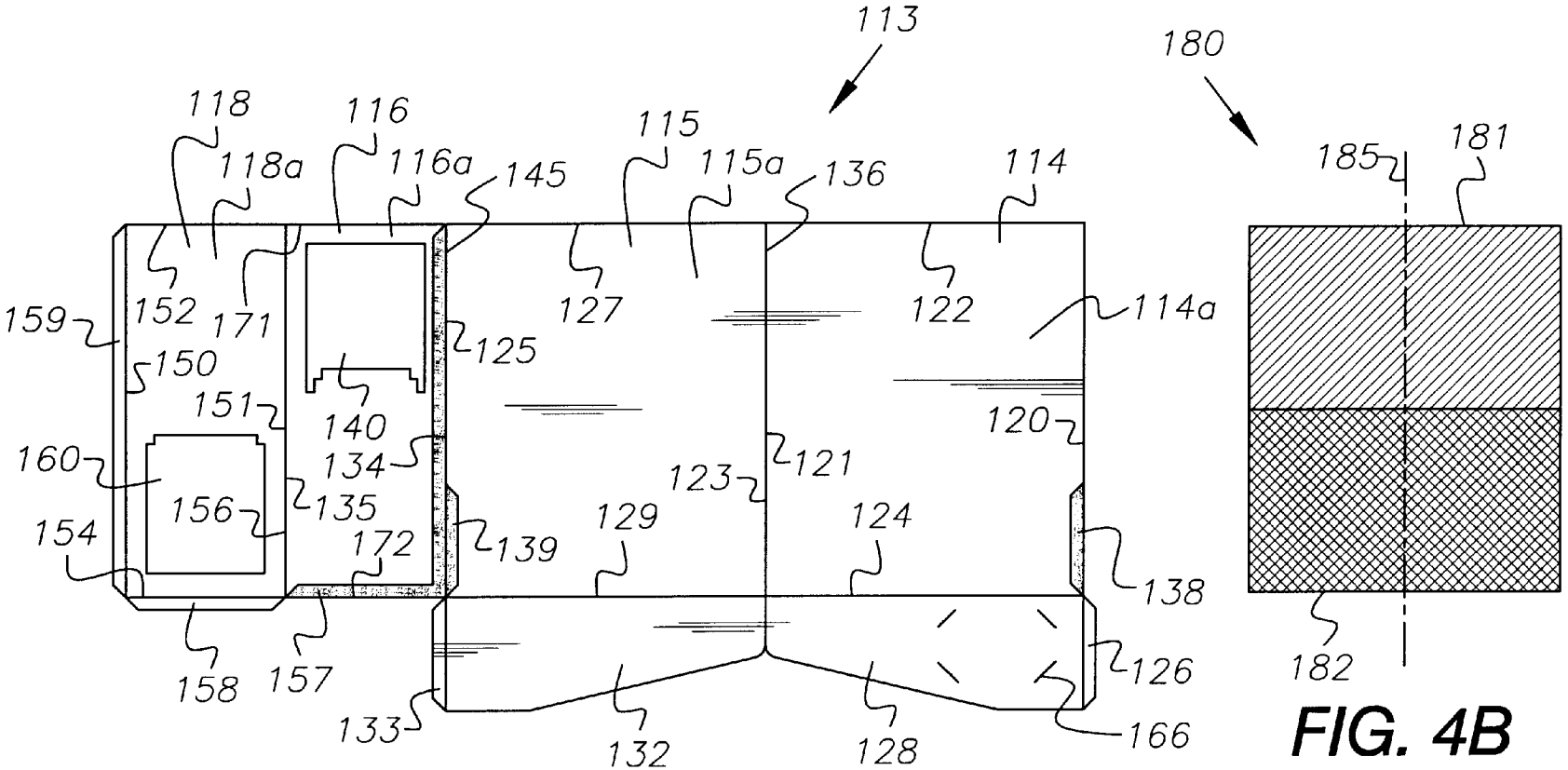
FIGS. 4A, 4B, 4C, and 4D.

The system of the invention is again comprised of a folio 113 and insert sheet(s). The folio of this second embodiment is also preferably rectangular in configuration, and as shown in FIG. 4A, is formed in part of a first front folio cover sheet 114, a second back folio cover sheet 115, a third front cover outer flap sheet 116, and a fourth front cover flap backing sheet 118. Front cover sheet 114 has long vertical side edges 120 and 121. In preferred form front cover sheet has a short upper edge 122 and a short lower edge 124. Front cover sheet 114 may also have one short bottom flap 128 that extends downwardly from bottom edge 124. Bottom flap 128 may have one short laterally disposed flap 126 that extends laterally from the edge of bottom flap 128. Short bottom flap 128 is adapted to be folded upwardly to cover a bottom portion of inner face 114*a* of the front cover sheet 114. Short lateral flap 126 is adapted to be folded under. Preferably there is adhesive 138 that couples together short lateral flap 126 and inner front cover sheet 114*a* to form a pocket 130 on the inner face of front cover sheet 114 for the receipt of supplemental materials.

Further, provided in this embodiment is the second sheet of the folio, namely back cover sheet 115. Back cover sheet 115 is also preferably in a rectangular configuration. Similarly, back cover sheet 115 has long vertical side edges 123 and 125. Vertical long edge 123 is preferably formed integrally with long vertical edge 121 of front cover sheet 114 of the folio along a first common joining or vertical fold line 136. (Alternatively, back folio cover sheet 115 may be formed separately and then hingedly joined to front cover-sheet 114.) In preferred form back cover sheet 115 has a short upper edge 127 and a short lower edge 129. Back cover sheet 115 may also have one short bottom flap 132 that extends downwardly from bottom edge 129. Bottom flap 132 may have one short laterally disposed flap 133 that extends laterally from the edge of bottom flap 132. Short bottom flap 132 is adapted to be folded upwardly to cover a bottom portion of the inner back cover sheet 115*a*. Short lateral flap 133 is adapted to be folded under. Preferably there is adhesive 139 that couples together short lateral flap 133 and inner back cover sheet 115*a* to form a pocket 131 in back cover sheet 115 for the receipt of supplemental materials.

Next provided in this embodiment is the front cover flap 117 comprised of an outer face sheet and an inner backing sheet. When the flap's outer face sheet and the inner backing sheet are secured to one another on three sides, a pocket is formed into which at least one insert sheet is placed. In FIG. 4A, the outer cover of front cover flap is shown as 116 and the front cover flap backing sheet is shown as 118. The inner face of flap's outer cover is shown as 116*a* and the inner face of the flap's backing sheet is shown as 118*a*.

Outer front cover flap 116 is also rectangular in configuration, having two long vertical side edges 134 and 135. Vertical long edge 134 is preferably formed integrally with long vertical edge 125 of the back cover sheet 115 along a second vertical fold line 145. (Alternatively, front cover flap 117 may be formed separately, and then hingedly joined to folio 113.) Front cover flap sheet 116 also has a short upper edge 171 and a short lower edge 172. In this embodiment, the short upper and lower edges 171 and 172 are roughly half the length of short upper and lower edges 127 and 129, respectively, of back cover sheet 115. (In other embodiments, the short upper and lower edges could be of other dimensions, as desired.) Front cover flap sheet 116 further has at least one cutout opening therein, which in the second preferred embodiment is shown as window opening 140. Front cover flap sheet 116 may also include an array of small cutout design openings(not shown) about window 140, if desired.

Figures 4C, 4D:
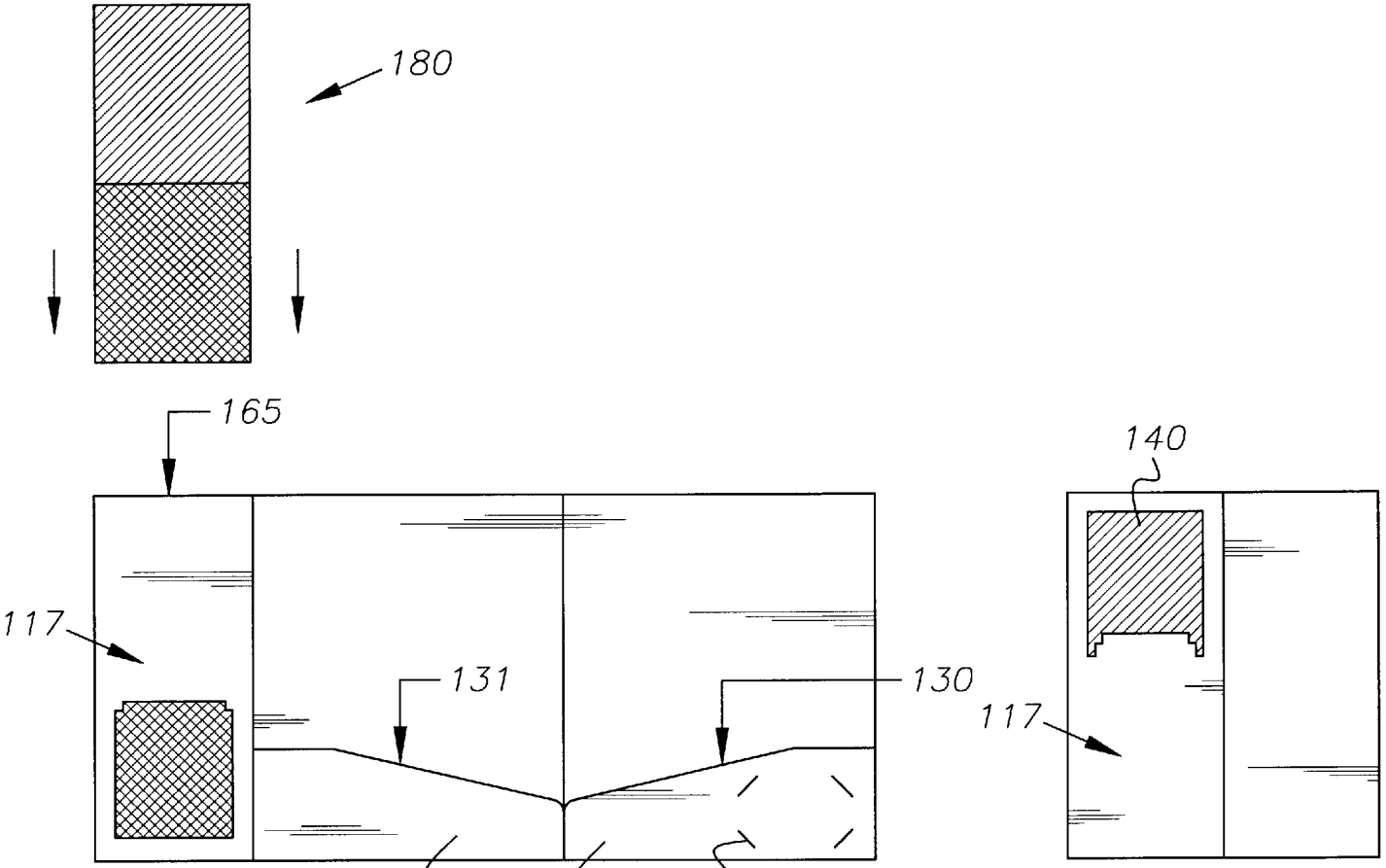

Next provided in this embodiment is the backing sheet 118 for the front cover flap 117. The front cover flap's backing sheet 118 is again preferably rectangular in configuration. The flap's backing sheet 118 may be formed separately from the flap's outer cover 116, but in a preferred style, is formed integrally with it. The flap's backing sheet 118 has at least one cutout opening therein, which in this embodiment is shown as design window opening 160. The flap's backing sheet 118 has long vertical side edges 150 and 151, plus a short upper edge 152 and a short lower edge 154. Long vertical edge 151 of the flap's backing sheet 118 is preferably formed integrally with long vertical edge 135 of the flap's outer front cover sheet 116 at a third common vertical fold line 156. (Alternatively, the flap's backing sheet can be formed separately, and then joined to the flap's outer cover so as to form a pocket between the flap's backing sheet and its cover.) The flap's backing sheet 118 may have a bottom flap 158 extending downwardly from bottom edge 154 and a lateral flap 159 extending alongside long vertical edge 150. To form insert sheet pocket 165, bottom flap 158 is folded up, lateral flap 159 is folded over, and the flap's backing sheet 118 is folded over and made to be in contact with the flap's outer front cover sheet 116. Preferably there is adhesive 157 along long vertical edge 134 and short lower edge 172 of the flap's outer front cover sheet to thereby form a pocket 165 with an open upper edge between the outer front cover sheet of the flap and the flap's backing sheet. Pocket 165 is shown in FIG. 4C.

Front cover flap backing sheet 118, or bottom flaps 128 and 132, may have means for securing a business card or other material thereto. In FIGS. 4A and 4C, the securing means are shown as four diagonal slits 166 in bottom flap 128 into which the four corners of the business card are placed. Still further, and also not shown, the securing means may be a pouch pocket in front cover backing sheet into which the business card is placed.

Lastly provided is an insert sheet 180 that is positionable within pocket 165. The other features of insert sheet 165 were discussed in the first preferred embodiment, and the discussion of that element will not be repeated here.

In this embodiment, since the folio's back and front covers are hingedly joined at edges 121 and 123, the folio "opens" from the left. When in a closed position, front cover flap 117 folds over and in part, secures the folio covers together.

In use, the folio may be supplied with insert sheet(s), or the insert sheet(s) can be supplied by the user. In either event, the folio user adds desired content, such as text, graphics, and/or pictures on or to the insert sheet(s) in the area(s) that will be exposed though cutout(s) in the outer front cover flap. The insert sheet(s) is then inserted into the pocket between the outer front cover flap, and the cover flap inner backing sheet. Additionally, the user may print or add desired content, such as text or graphics, on two separate portions of an insert sheet whose upper and lower edges 181 and 182 are roughly twice the lateral length of pocket 165. The separate portions on the insert sheet will correspond to the cutout areas in the folio cover flap when the insert sheet is folded and placed in the pocket between the flap's outer cover and its backing sheet. The user need only fold the insert sheet along a vertical center line 185 and insert the sheet into pocket 165. In this manner, the desired content is visible through both window openings 140 and 160. For the folio of the second preferred embodiment, desired materials can then be placed in the folio.

DESCRIPTION OF A THIRD PREFERRED EMBODIMENT

Figure 5A:
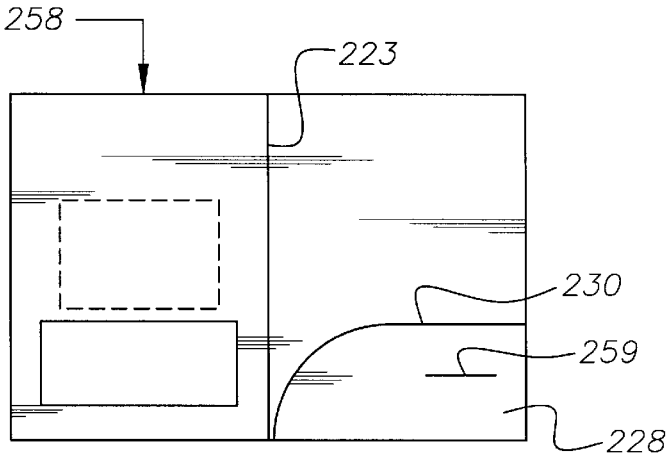
FIGS. 5A and 5B.
Figure 5B:
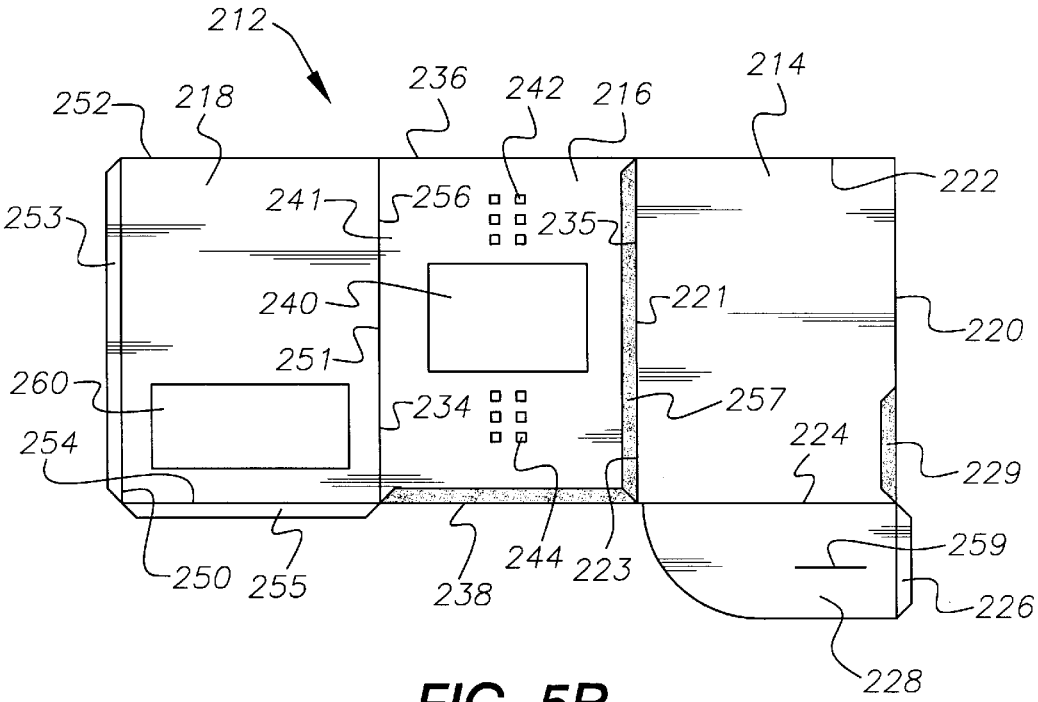

With reference now to the drawings, and in particular, to FIGS. 5A and 5B thereof, a third preferred embodiment of the new folio cover system embodying the principles and concepts of the present invention and generally designated by the reference number 212 will be described. The third preferred embodiment features a front cover backing sheet attached to the lower and lateral edges of the outer front cover sheet to thereby form a pocket between the outer cover sheet and the inner backing sheet with an opening at the upper edge.

Specifically, in a third preferred embodiment the present invention is a folio 212, as shown in FIGS. 5A and 5B. The folio is preferably rectangular in configuration, and in the third preferred embodiment is formed of a first rear or back cover sheet 214, a second outer front cover sheet 216 and a third front cover backing sheet 218. Back cover sheet 214 has long vertical side edges 220 and 221. In this preferred form it also has a short upper edge 222 and a short lower edge 224. Back cover sheet 214 may have a short bottom flap 228 that extends downwardly from bottom edge 224. Short bottom flap 228 may have one short laterally disposed flap 226. Short bottom flap 228 is adapted to be folded upwardly to cover a portion of the back cover sheet. Short lateral flap 226 is adapted to be folded under. Preferably there is adhesive 229 that couples together short lateral flap 226 and back cover sheet 214 to form a pouch pocket 230 in back cover sheet 214 for the receipt of supplemental materials. Alternatively, but not shown, the pouch pocket may be formed of a lateral flap adapted to be folded inwardly so as to be in contact with the inner face of the back cover sheet.

Next provided in this embodiment is the folio's second sheet, namely outer front cover sheet 216. Outer front cover sheet 216 is also preferably in a rectangular configuration. Outer front cover sheet 216 has two long vertical side edges, 234 and 235. Outer front cover sheet 216 may be formed separately from back cover sheet 214, but in a preferred style is formed integrally with it. Specifically, vertical long edge 235 of outer front cover sheet 216 is formed integrally with long vertical edge 221 of back cover sheet 214 of the folio, along a first common joining or vertical fold line 223. Outer front cover sheet 216 further has a short upper edge 236 and a short lower edge 238. Outer front cover sheet 216 has at least one cutout opening therein, which in this embodiment is shown as a large rectangular window opening 240. Such an opening is preferably located in the central extent 241 of outer front cover sheet 216. Outer front cover sheet 216 still further preferably has an array of small cutout design openings 242 above the large window opening 240. There also may be an array of small cutout design openings 244 beneath large window opening 240.

Next provided in this embodiment is the third folio sheet, namely the inner front cover backing sheet 218. Inner front cover backing sheet 218 is also preferably in a rectangular configuration. Inner front cover backing sheet may be formed separately from outer front cover 216, but in a preferred style, is formed integrally with it. Inner front cover backing sheet 218 has long side edges 250 and 251. It also has a short upper edge 252 and a short lower edge 254. Long edge 251 of inner front cover backing sheet 218 is preferably formed integrally with long vertical edge 234 of outer front cover sheet 216 at a second common joining or vertical fold line 256. Inner front cover backing sheet 218 has at least on cutout section therein, which in this embodiment is shown as rectangular window opening 260. Inner front cover baking sheet may have a lateral flap 253 extending along vertical edge 250, and a bottom flap 255 extending downwardly from bottom edge 254. In this embodiment, lateral flap 253 is folded in, bottom flap 255 is folded up, and inner front backing sheet 218 is folded over and made to be in contact with outer front cover sheet 216. Preferably, adhesive 257 couples lateral flap 253 and bottom flap 255 to front cover sheet 216 to thereby form a pocket 258 with an open upper edge between the outer front cover sheet and the front cover backing sheet. Pocket 258 is shown in FIG. 5A.

Front cover backing sheet 218, or short bottom flap 228 may have means for securing a business card or other material thereto. The securing means are shown as slit 259, into which a brochure or other material(s) can be placed. Alternatively, but not shown, the securing means may be slits in short bottom flap 228 into which the corners or edges of a business card are placed. Still further, and also not shown, the securing means may be a pouch pocket in front cover backing sheet 218 into which brochures or other material(s) are placed.

Lastly provided in this embodiment is at least one insert sheet (not shown). The insert sheet(s) is substantially the same as in the discussion of the first preferred embodiment and, accordingly, will not be discussed herein.

DESCRIPTION OF A FOURTH PREFERRED EMBODIMENT

Figure 6A:
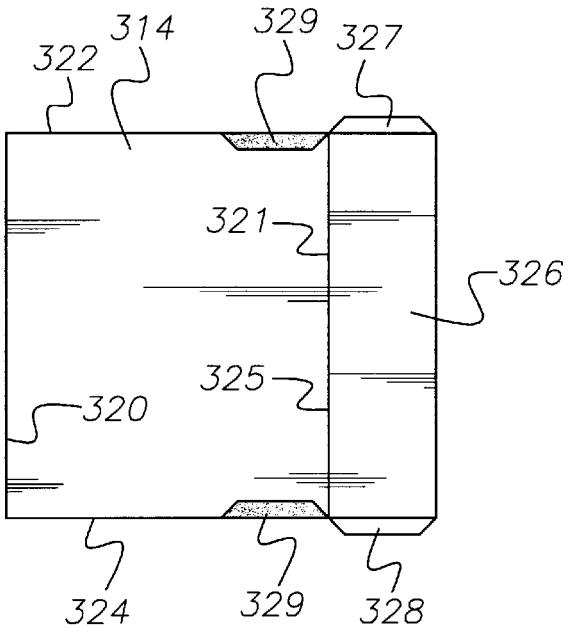
FIGS. 6A, 6B, and 6C.
Figure 6B:
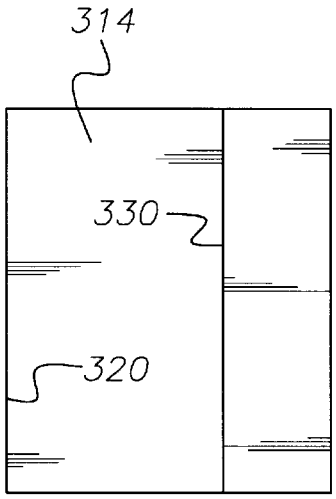

In the fourth preferred embodiment the front and back folio covers are formed separately from one another, and are designed to be later bound, or otherwise suitably joined together. This form of the invention is shown in FIGS. 6A–6C.

The system of the invention is again comprised of a folio and an insert sheet(s). The folio of this fourth embodiment is also preferably rectangular in configuration, and as shown in FIG. 6A, is formed in part of a first rear or back cover sheet 314. As shown in FIG. 6C, the folio of this embodiment is also formed of a separate second outer front cover sheet 316 and a third front cover backing sheet 318. Back cover sheet 314 has long vertical side edges 320 and 321. In preferred form back cover sheet has a short upper edge 322 and a short lower edge 324. Back cover sheet 314 may also have one laterally disposed flap 326 that extends the length of vertical edge 321. Lateral flap 326 may have a short top flap 327 that extends upwardly from the top edge of lateral flap 326, and a short bottom flap 328 that extends downwardly from the bottom edge of lateral flap 326. Bottom flap 328 is adapted to be folded upwardly, and top flap 327 is adapted to be folded downwardly. Lateral flap 326 is adapted to be folded inwardly along vertical fold line 325 so as to be in contact with the inner face of back cover sheet 314. Top flap 327 and bottom flap 328 preferably have adhesive 329 that couples short top flap 327 and short bottom flap 328 to the inner face of back cover sheet 314 to form a lateral pouch pocket 330 for the receipt of supplemental sheets of material.

Figure 6C:
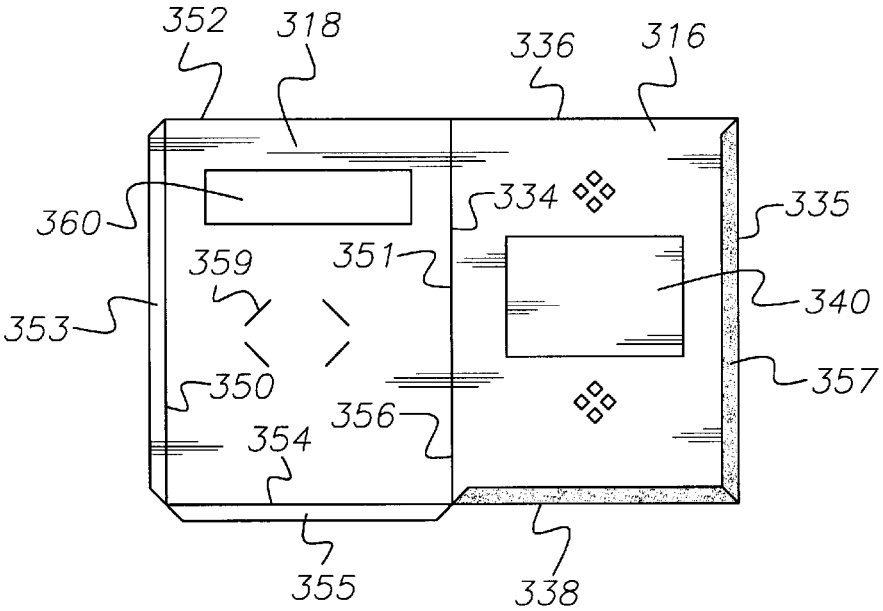

As shown in FIG. 6C, next provided in this embodiment is the folio's separate outer front cover 316. Outer front cover 316 is preferably in a rectangular configuration, having long vertical side edges 334 and 335. It further has a short upper edge 336 and a short lower edge 338. Outer front cover 316 is formed with at least one cutout therein, which in this embodiment is shown as large rectangular window opening 340. Front cover sheet 316 further preferably has an array of small cutout openings above and below large rectangular window opening 340.

Next provided is inner front cover backing sheet 318, which is also preferably in a rectangular configuration. Inner front cover backing sheet may be formed separately from outer front cover 316, but in a preferred style, is formed integrally with it. Inner front cover backing sheet 318 has long side edges 350 and 351, a short upper edge 352 and a short lower edge 354. Inner front cover backing sheet further has cutout section 360 therein corresponding to the different optical characteristics on a side of the insert sheet. In preferred form, inner front backing sheet has lateral flap 353 that extends laterally along the length of vertical edge 350. In addition there is a bottom flap 355 that extends downwardly from short lower edge 354. Lateral flap 353 is adapted to be folded inwardly and bottom flap 355 is adapted to be folded upwardly. Long edge 351 of the inner front cover backing sheet 318 is preferably formed integrally with long vertical edge 334 of outer front cover sheet 316 to form a joining or vertical fold line 356. When the outer front cover sheet is formed integrally with the inner front backing sheet, the inner front backing sheet 318 is folded over and in contact with outer front cover sheet 316. Preferably adhesive 357 couples lateral flap 353 and bottom flap 355 of front cover backing sheet 318 to front cover sheet 316 to thereby form a pocket with an open upper edge between the outer front cover sheet and the front cover backing sheet.

Front cover backing sheet 318, or lateral flap 326, may have means for securing a business card or other supplemental material(s) thereto. In FIG. 6C, the securing means are shown as four diagonal slits 359 in front cover backing sheet 318 into which the four corners of the business card are placed. Still further, and also not shown, the securing means may be a pouch pocket in front cover backing sheet into which a business card, a brochure, or other supplemental material is placed.

Lastly provided is at least one insert sheet that is positionable within the pocket. The Insert sheet(s) was discussed in the first preferred embodiment, and the discussion of that element will not be repeated here.

In use, the folio may be supplied with insert sheet(s), or the insert sheet(s) can be supplied by the user. In either event, the folio user adds desired content, such as text, graphics or images, to the insert sheet(s) in the area(s) that will be exposed though cutout(s) in the folio cover or the backing sheet. The insert sheet is then inserted into the pocket between the outer cover sheet, and the folio cover inner backing sheet. For the folio of the first preferred embodiment, desired materials can then be placed in the folio. If the folio of the second preferred embodiment is being used, desired materials are placed between the front and back folio covers, which are then bound or otherwise joined together.

DESCRIPTION OF A FIFTH PREFERRED EMBODIMENT

Figure 7:
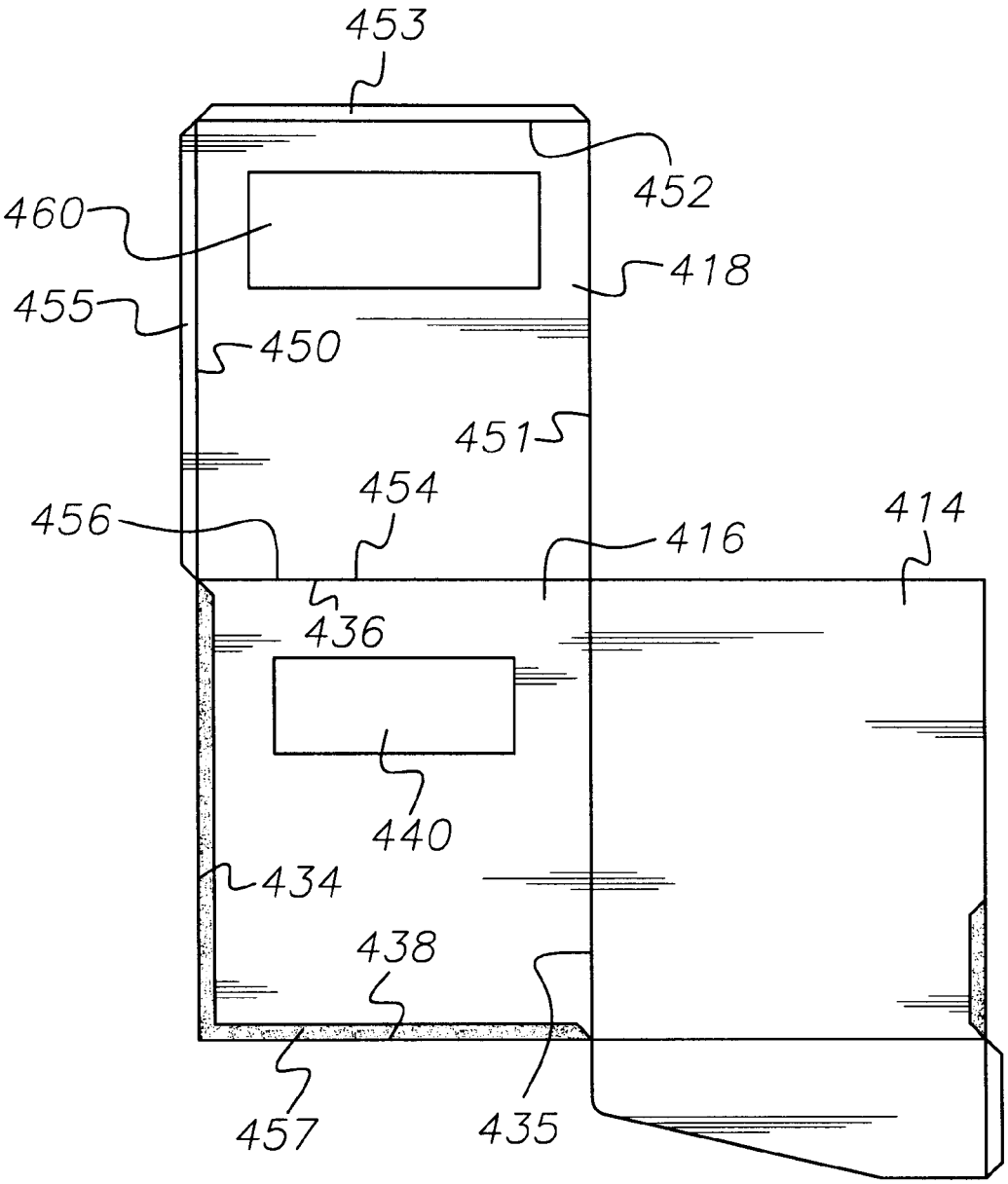
FIG. 7 is a plan view of a fifth preferred embodiment of the present invention in a spread orientation.

Referring to FIG. 7, the folio system of the fifth preferred embodiment includes a front cover backing sheet that is integrally attached to an upper edge of the front cover sheet. Otherwise, the fifth preferred embodiment is substantially the same as the third preferred embodiment.

Specifically, the folio system of the fifth preferred embodiment has a back cover 414, a front cover sheet 416, and a front cover backing sheet 418. Front cover sheet 416 has short upper edge 436 and short lower edge 438. Front cover backing sheet 418 has lateral edges 450 and 451. Front cover backing sheet 418 further has short upper edge 452 and short lower edge 454. Front cover backing sheet 418 is formed integrally with front cover sheet 416. Specifically, lower edge 454 is formed integrally with short upper edge 436 of front cover sheet 416 to define a common joining or horizontal fold line 456. Front cover backing sheet 418 further has short top flap 453 extending upwardly from upper edge 452 and short lateral flap 455 extending from lateral edge 450.

To form a pocket for placement of at least one insert sheet, top flap 453 is folded down and lateral flap 455 is folded in. Preferably, top flap 453 and lateral flap 455 have adhesive 457 that couples top flap 453 and lateral flap 455 to the inner face of front cover sheet 416 to form a pocket with an opening at a lateral edge of front cover sheet 416 for the receipt of at least one insert sheet.

The remaining components, features and assembly of the fifth preferred embodiment are identical to the third preferred embodiment. Reference should be had to the description of the third preferred embodiment, as such description will not be repeated here.

DESCRIPTION OF A SIXTH PREFERRED EMBODIMENT

Figure 8:
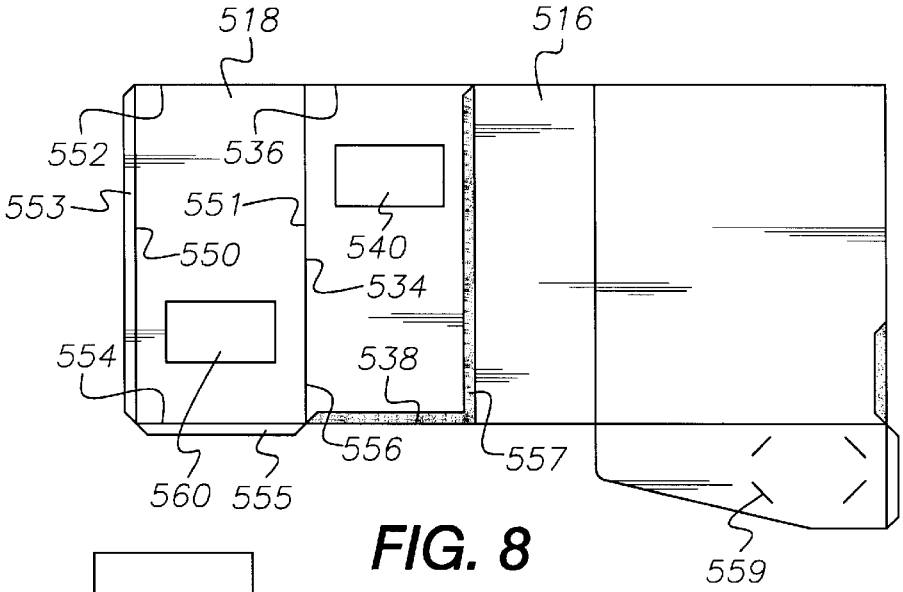
FIG. 8 is a plan view of a sixth preferred embodiment of the present invention in a spread orientation.
Figure 9A:
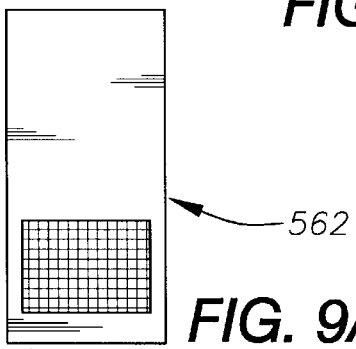
FIGS. 9A and 9B.
Figure 9B:
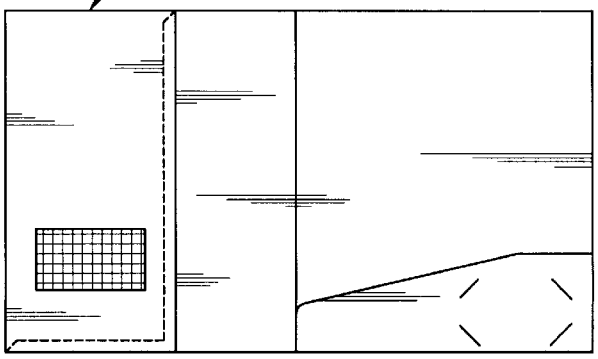
Figure 10:
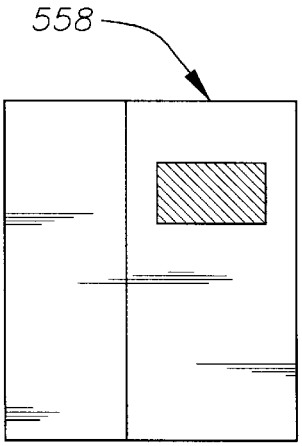
FIG. 10 is a front view of a sixth preferred embodiment constructed in accordance with the principles of the present invention.

In a sixth preferred embodiment the inner backing sheet 518 is smaller in size along the upper and lower edges than the outer front cover sheet 516. This form of the invention is shown in FIGS. 8–10. The system of the invention is again comprised of a folio and an insert sheet(s). The folio of this sixth embodiment is also preferably rectangular in configuration. As shown in FIG. 8, short upper edge 552 and short lower edge 554 of backing sheet 518 are shorter in length than short upper edge 536 and short lower edge 538 of outer front cover 516. Accordingly, coupling outer front cover sheet 516 and backing sheet 518 results in a smaller pocket for placement of correspondingly smaller insert sheet(s). See FIGS. 9A, 9B and 10. In this embodiment, the cutout 540 is in front cover sheet 516, while another rectangular cutout section 560 is in the inner backing sheet 518. Otherwise, the design and assembly of the sixth preferred embodiment is substantially the same as the third preferred embodiment.

A description of the assembly of the smaller pocket follows. Inner front cover backing sheet 518 is again preferably rectangular in configuration. Inner front cover backing sheet 518 may be formed separately from outer front cover sheet 516, but in preferred style is formed integrally with it. Inner front cover backing sheet 518 has long side edges 550 and 551. It also has short upper edge 552 and short lower edge 554. In preferred form, front cover backing sheet has a lateral flap 553 which extends laterally along the length of vertical edge 550. Additionally, backing sheet 518 includes short bottom flap 555 which extends downwardly from short lower edge 554. Lateral flap 553 is adapted to be folded inwardly and bottom flap 555 is adapted to be folded upwardly. Long edge 551 of inner front cover backing sheet 518 is formed integrally with long vertical edge 534 of outer front cover sheet 516 to form a common joining or vertical fold line 556. To form the pocket, inner front cover backing sheet 518 is folded over and into contact with the inner face of outer front cover sheet 516. Preferably, adhesive 557 couples lateral flap 553 and bottom flap 555 to outer front cover sheet 516, thereby forming a pocket 558 with an open upper edge between outer front cover sheet 516 and backing sheet 518. Pocket 558 is shown in FIGS. 9B and 10. An insert sheet 562, which is substantially the same size as the pocket between inner front cover backing sheet 518 and outer front cover sheet 516, is then positioned within pocket 558. The insert sheet is visible through cutouts in both the front cover sheet and the inner backing sheet.

In addition, the pouch has slits 559 into which the four corners of a business card may be placed.

The remaining components, features and assembly of the sixth preferred embodiment are identical to the third preferred embodiment. Reference should be had to the description of the third preferred embodiment, as such description will not be repeated here.

DESCRIPTION OF A SEVENTH PREFERRED EMBODIMENT

A seventh preferred embodiment of the present invention provides a customizable folio system where in the front cover sheet has two separate pockets for the receipt of insert sheets or other materials, such as a brochure or a map. The double-pocket folio cover of this embodiment includes a front or outer cover 616 and two backing sheets 618*a* and 618*b* joined to outer cover 616 at opposite edges. As in the fourth preferred embodiment, the front cover is formed separately from the back cover. Accordingly, the front and back folio covers must be bound or otherwise suitably joined together.

Figure 11A:
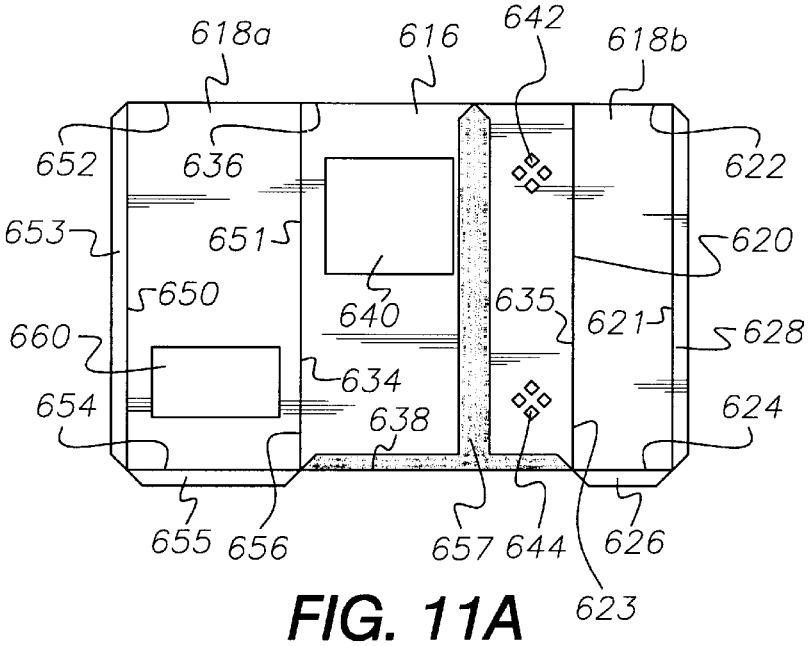
FIGS. 11A, 11B, and 11C.
Figure 11B:
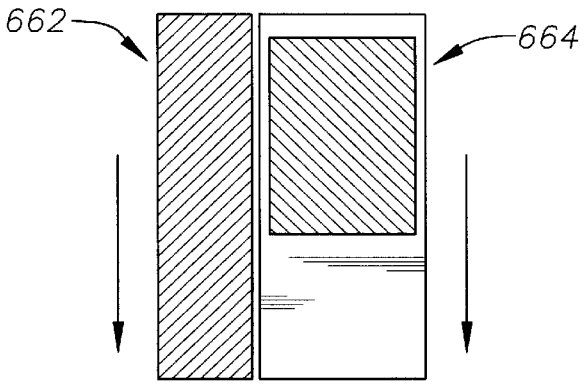
Figure 11C:
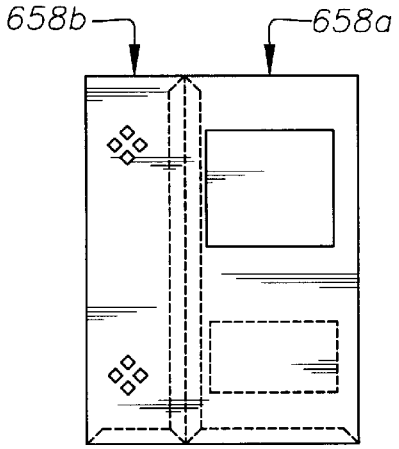

As shown in FIGS. 11A–11C, provided in this embodiment is the folio's separate outer front cover 616. Outer front cover 616 is preferably in a rectangular configuration, having long vertical side edges 634 and 635. It further has a short upper edge 636 and a short lower edge 638. Outer front cover 616 is formed with at least one cutout therein, which in this embodiment is shown as large rectangular window opening 640. Front cover sheet 616 further has an array of small cutout openings 642 and 644 located laterally to large rectangular window opening 640. Window opening 640 corresponds to pocket 658*a*, while small cutout openings 642 and 644 correspond to pocket 658*b*. See FIGS. 11A–11C.

Next provided is first and second inner front cover backing sheets 618*a* and 618*b*, which are also preferably in a rectangular configuration. First inner front cover backing sheet 618*a* may be formed separately from outer front cover 616, but in a preferred style, is formed integrally with it. Inner front cover backing sheet 618*a* has long side edges 650 and 651, a short upper edge 652 and a short lower edge 654. First inner backing sheet 618*a* further has cutout section 660 therein. In preferred form, inner front backing sheet 618*a* has lateral flap 653 that extends laterally along the length of vertical edge 650. In addition there is a bottom flap 655 that extends downwardly from short lower edge 654. Lateral flap 653 is adapted to be folded inwardly and bottom flap 655 is adapted to be folded upwardly. Long edge 651 of the inner front cover backing sheet is preferably formed integrally with long vertical edge 634 of outer front cover sheet 616 to form a joining or vertical fold line 656. When the outer front cover sheet is formed integrally with the inner front backing sheet, the inner front backing sheet 618*a* is folded over and in contact with outer front cover sheet 616. Preferably, adhesive 657 couples lateral flap 653 and bottom flap 655 to the inner face of front cover sheet 616 to thereby form a pocket 658*a* with an open upper edge between the outer front cover sheet 616 and front cover backing sheet 618*a*. Pocket 658*a* is shown in FIG. 11C.

Next provided in this embodiment is second inner front cover backing sheet 618*b*. Inner front cover backing sheet 618*b* may be formed separately from outer front cover 616, but in a preferred style, is formed integrally with it. Inner front cover backing sheet 618*b* has long side edges 620 and 621, a short upper edge 622 and a short lower edge 624 In preferred form, inner front backing sheet 618*b* has lateral flap 628 that extends laterally along the length of vertical edge 621. In addition there is a bottom flap 626 that extends downwardly from short lower edge 624. Lateral flap 628 is adapted to be folded inwardly and bottom flap 626 is adapted to be folded upwardly. Long edge 620 of the inner front cover backing sheet is preferably formed integrally with long vertical edge 635 of outer front cover sheet 616 to form a joining or vertical fold line 623. When the outer front cover sheet is formed integrally with the inner front backing sheet, the inner front backing sheet 618*b* is folded over and in contact with outer front cover sheet 616. Preferably, adhesive 657 couples lateral flap 628 and bottom flap 626 to the inner face of front cover sheet 616 to thereby form a pocket 658*b* with an open upper edge between the outer front cover sheet 616 and front cover backing sheet 618*b*. Pocket 658*b* is shown in FIG. 11C.

Lastly, provided in the seventh preferred embodiment are first insert sheet 662 and second insert sheet 664. First insert sheet 662 is sized to be positionable within pocket 658*b*. Similarly, second insert sheet 664 is sized to be positionable within pocket 658*a*. In use, the user may place a variety of materials into pockets 658*a* and 658*b*. By way of example, pocket 658*a* and pocket 658*b* may be sized such that the user may place a brochure in pocket 658*a* and an insert sheet in pocket 658*b* to create a customized folio cover. In this manner, pocket 658*b* holds material that creates a design element in both the outer front cover sheet and the inner backing sheet of the folio cover and pocket 658*a* holds material that provides information to the user should the user remove the brochure from the pocket.

The remaining components, construction and assembly of the seventh preferred embodiment are substantially identical to the fourth preferred embodiment. Therefore, reference should be had to the discussion of the fourth preferred embodiment as such disclosure will not be repeated here.

DESCRIPTION OF AN EIGHTH PREFERRED EMBODIMENT

Figure 12A:
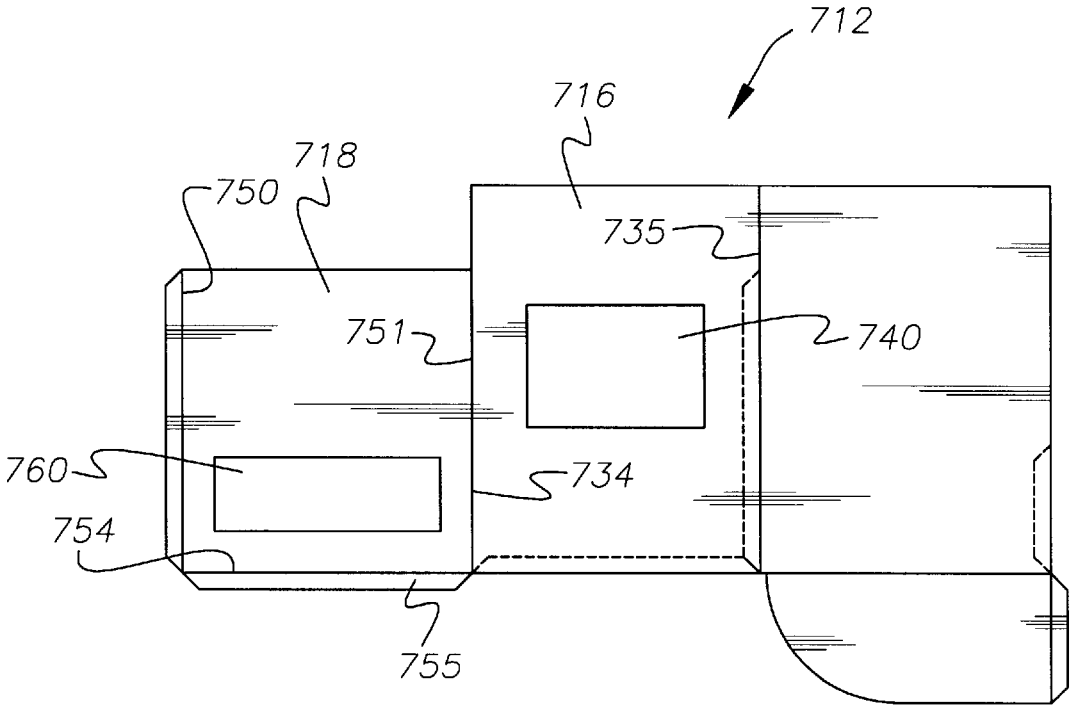
FIGS. 12A and 12 B.
Figure 12B:
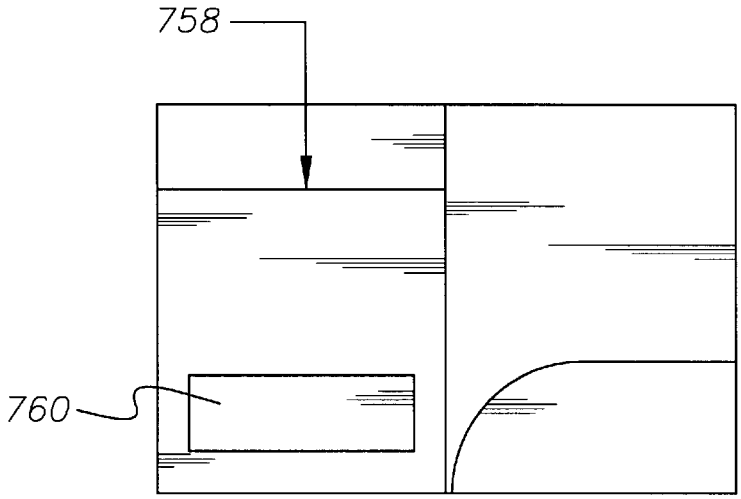

As illustrated in FIGS. 12A and 12B, an eighth preferred embodiment provides a customizable folio system wherein the vertical edges 750 and 751 of the inner backing sheet 718 are shorter than the vertical edges 734 and 735 of the front cover sheet 716. This configuration effects a smaller pocket 758 facilitating placement or removal of an insert sheet or other materials, such as a brochure. (Preferably, in other embodiments not shown, smaller pocket 758 will be formed of a backing sheet having vertical edges that are at least about one half the length of the vertical edges of the front cover sheet.) Otherwise, the eighth preferred embodiment is substantially identical to the third preferred embodiment in components, construction, and assembly.

By way of example, the smaller pocket 758 could hold a brochure, part of which will be visible through cutout section 740 in front cover sheet 716. Further, if the length of the brochure exceeds the vertical edges 750 and 751 of the backing sheet 718, the user will have easier access to the brochure, when the folio 712 is opened. Furthermore, front cover backing sheet 718 may include a slit that defines a flap (not shown) for the receipt of supplemental materials. With such a flap pocket, the bottom edge of any inserted supplemental materials rests against lower edge 754 and between the flap and front cover sheet 716.

DESCRIPTION OF A NINTH PREFERRED EMBODIMENT

The folio system of the ninth preferred embodiment has both a front cover having a pocket for placement of insert sheet(s) and a front cover flap to secure the folio in a closed orientation. The front cover sheet also has a window cutout through which an insert sheet is visible. Further, the front cover flap has a cutout window corresponding to the cutout window of the front cover sheet such that the insert sheet remains visible when the front cover flap is folded over the front cover.

With reference now to the drawings, and in particular, to FIGS. 13 A–D thereof, a ninth preferred embodiment of the new folio system embodying the principles and concepts of the present invention will be described.

Figure 13A:
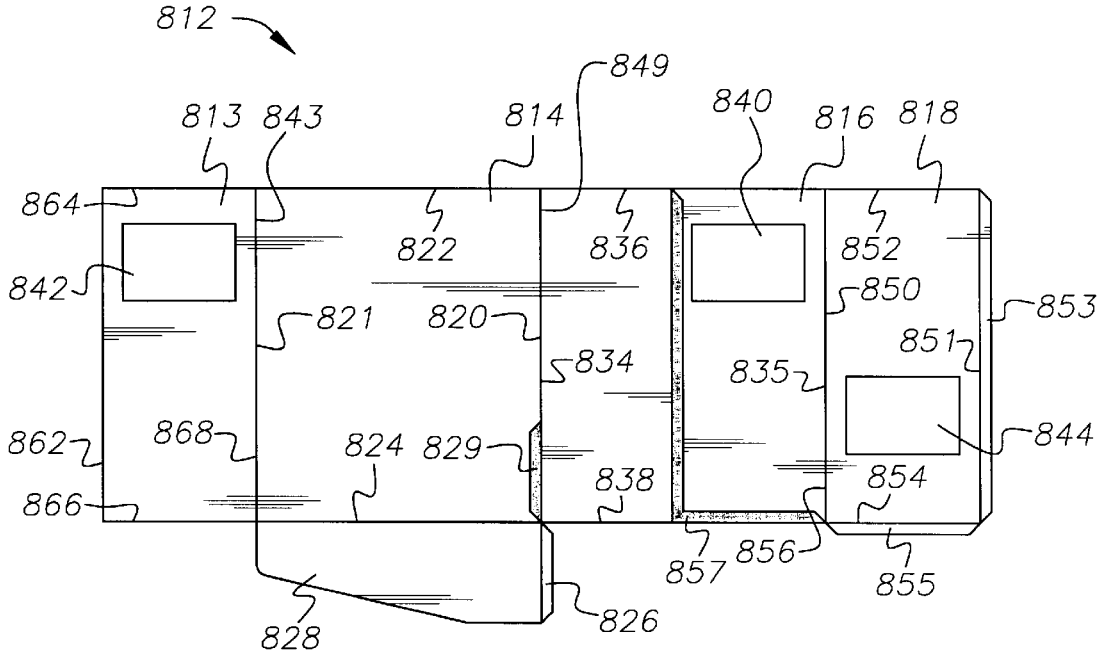
FIGS. 13A, 13B, 13C, and 13D.

More specifically, in the ninth preferred embodiment the present invention is a system, having a folio 812, as shown in FIG. 13A. The folio is preferably rectangular in configuration, and in the ninth preferred embodiment is formed of a first rear or back cover sheet 814, a second outer front cover sheet 816, a third front cover backing sheet 818, and a front cover flap 813. Back cover sheet 814 has long vertical side edges 820 and 821. In this preferred form it also has a short upper edge 822 and a short lower edge 824. Back cover sheet 814 may have a short bottom flap 828 that extends downwardly from bottom edge 824. Short bottom flap 828 may have one short laterally disposed flap 826. Short bottom flap 828 is adapted to be folded upwardly to cover a portion of the back cover sheet. Short lateral flap 826 is adapted to be folded under. Preferably there is adhesive 829 that couples together short lateral flap 826 and back cover sheet 814 to form a pouch pocket 830 in back cover sheet 814 for the receipt of supplemental material(s).

Next provided in this embodiment is the folio's second sheet, namely outer front cover sheet 816. Outer front cover sheet 816 is also preferably in a rectangular configuration. Outer front cover sheet 816 has two long vertical side edges, 834 and 835. Vertical long edge 834 of outer front cover sheet 816 is formed integrally with long vertical edge 820 of back cover sheet 814 of the folio along a first common joining or vertical fold line 849. Outer front cover sheet 816 further has a short upper edge 836 and a short lower edge 838. Outer front cover sheet 816 has at least one cutout opening therein, which in this embodiment is shown as a large rectangular window opening 840.

Figure 13B:
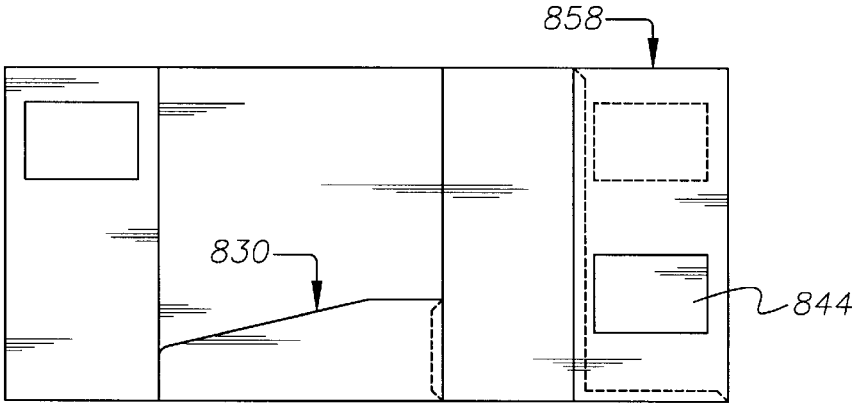
Figure 13C:
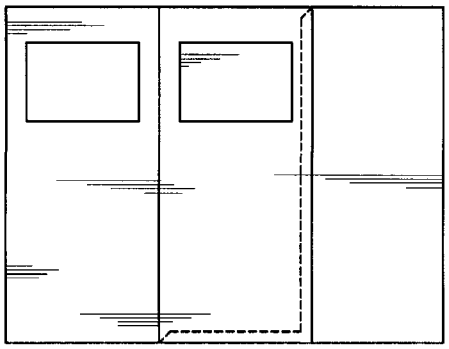
Figure 13D:
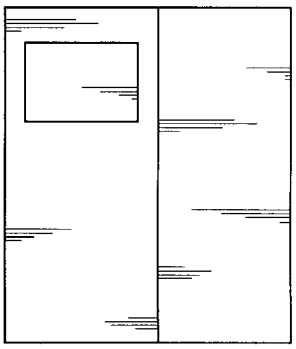

Next provided in this embodiment is the third folio sheet, namely the inner front cover backing sheet 818. Inner front cover backing sheet 818 is also preferably in a rectangular configuration. Inner front cover backing sheet 818 may be formed separately from outer front cover 816, but in a preferred style, is formed integrally with it. Inner front cover backing sheet 818 has long side edges 850 and 851. It also has a short upper edge 852 and a short lower edge 854. Long edge 850 of inner front cover backing sheet 818 is preferably formed integrally with long vertical edge 835 of outer front cover sheet 816 at a second common joining or vertical fold line 856. Inner front cover backing sheet 818 may have a lateral flap 853 extending along vertical edge 851 and a bottom flap 855 extending downwardly from bottom edge 854. In this embodiment, lateral flap 853 is folded in, bottom flap 855 is folded up, and inner front backing sheet 818 is folded over and made to be in contact with outer front cover sheet 816. Preferably adhesive 857 couples lateral flap 853 and bottom flap 855 to front cover sheet 816 to thereby form a pocket 858 with an open upper edge between the outer front cover sheet and the front cover backing sheet. Pocket 858 is shown in FIG. 13B.

Next provided is front cover flap 813, which is also preferably in a rectangular configuration. Front cover flap 813 has two long vertical side edges, 862 and 868. Vertical long edge 868 of front cover flap 813 is formed integrally with long vertical edge 821 of back cover sheet 814 of the folio, along a third common joining or vertical fold line 843. Front cover flap 813 further has a short upper edge 864 and a short lower edge 866. Front cover flap 813 has at least one cutout opening therein, which in this embodiment is shown as a large rectangular window opening 842. Window opening 842 corresponds to window opening 840 in outer front cover sheet 816 such that the insert sheet remains visible through both window openings 840 and 842, when front cover flap 813 is folded over front cover sheet 816. The insert sheet is also visible through window opening 844 in inner backing sheet 818 when the folio is in an open configuration.

The insert sheet of the ninth preferred embodiment does not represent a change from previous embodiments. Accordingly, the insert sheet will not be discussed herein.

SUMMARY

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described. Accordingly, all suitable modifications and equivalents which may be resorted to fall within the scope of the invention.

What is claimed as being new and desired to be protected by Letters Patent of the United States is as follows:

1. A customizable cover system for a folio or report comprising an outer cover sheet said outer cover sheet having a cutout window section therethrough, an inner backing sheet, said inner backing sheet attached along three edges thereof to said outer cover sheet so as to form a pocket between said outer cover sheet and said inner backing sheet, said inner backing sheet having a cutout window section therethrough, a user customizable insert sheet capable of being imprinted upon by a laser or ink jet printer, wherein said insert sheet is positionable in said pocket between said outer cover sheet and said inner backing sheet, and further wherein the areas of said insert sheet visible through said cutout window sections when said insert sheet is positioned in said pocket have no pre-applied indicia thereon.

2. The report cover system of claim 1 wherein said insert sheet has at least one area of color and/or texture thereon.

3. The report cover system of claim 2 wherein said area of color and/or texture on said insert sheet is approximately co-extensive with said cutout window section in said outer cover sheet and is visible through said cutout window section in said outer cover sheet when said insert sheet is placed in said pocket.

4. A cover system of claim 1 wherein said inner backing sheet is substantially the same size as the outer cover sheet.

5. A cover system of claim 1 wherein said inner backing sheet has at least one vertical edge that is substantially the same length as at least one vertical edge of the outer cover sheet.

6. A cover system of claim 1 wherein said backing sheet is affixed to the outer cover sheet along the lateral and bottom edges of said baking sheet so as to form a pocket with an open upper edge between the outer cover sheet and said inner backing sheet.

7. A cover system of claim 1 wherein said backing sheet is affixed to the outer cover sheet along the bottom, upper and a lateral edge of said backing sheet so as to form a pocket with an open lateral edge between the outer cover sheet and said inner backing sheet.

8. A cover system of claim 1 wherein said insert sheet has adhesive means for securing said insert sheet in said pocket between said outer cover sheet and said inner backing sheet.

9. A cover system according to claim 1 further comprising a second folio cover attached to said outer cover sheet.

10. A cover system according to claim 9 wherein said second folio cover has at least one pouch pocket therein.

11. A cover system of claim 9 wherein said second folio cover includes a cover flap affixed to an edge of said second folio cover such that said flap folds over to partially cover and thereby secure said first folio cover.

12. A cover system of claim 11 wherein said cover flap has at least one cutout section corresponding to said at least one cutout section in said outer cover sheet such that said insert sheet remains visible through said cutout sections when said cover flap is folded over said outer cover sheet.

13. A folio system comprising an insert sheet, and a folio formed of a first sheet, a second sheet and a third sheet;

the first sheet being formed integrally with the second sheet, the second sheet having at least one cutout window section therethrough with one edge of the second sheet being formed integrally with one edge of the first sheet along a common first vertical fold line;

the third sheet being formed integrally with one edge of the second sheet remote from the first sheet to form a common second vertical fold line, the third sheet being folded over and in contact with the second sheet and coupled thereto along an edge of the third sheet remote from the second sheet and along a lower edge thereof to thereby form a pocket with an open upper edge between the second and third sheets, said third sheet having at least one cutout window section therethrough;

said insert sheet capable of being imprinted upon by a laser or ink jet printer and selectively positionable within said pocket, wherein said insert sheet has no pre-applied indicia thereon.

14. A folio system of claim 13 wherein the second sheet further has at least one set of cutout openings wherein said cutout openings form a design element in the outer face of said second sheet.

15. A folio system of claim 13 wherein said first sheet has one bottom flap extending downwardly from the bottom edge and one short laterally disposed flap extending laterally from one vertical edge of the bottom flap, the short laterally disposed flap adapted to be folded over to cover a portion of the bottom flap and the bottom flap adapted to be folded upwardly to cover a portion of the first sheet with adhesive coupling together the short laterally disposed flap and the first sheet to form a pouch pocket for the receipt of supplemental material.

16. A folio system of claim 13 wherein said second sheet is formed with a plurality of openings therethrough and said insert sheet includes preprinted color for being viewed through the plurality of openings in the second sheet.

17. A folio system of claim 13 wherein said insert sheet includes means for securing supplemental material thereto, wherein the supplemental material is selected from the group consisting of a business card, a photograph, textual material, pictorial material, and graphic material.

18. A folio system of claim 17 wherein the regions of said insert sheet having materials attached thereto are viewable through the openings in said second sheet.

19. A first cover system comprising an outer cover sheet, first and second backing sheets and at least one user customizable insert sheet capable of being imprinted upon by a laser or ink jet printer, wherein three edges of said first backing sheet are affixed to the outer cover sheet so as to form a first pocket between the outer cover sheet and said first backing sheet into which an insert sheet can be placed, wherein three edges of said second backing sheet are affixed to the outer cover sheet so as to form a second pocket between said outer cover sheet and said second backing sheet, wherein the outer cover sheet has at least one cutout window section therein, wherein at least one of said backing sheets has a cutout window section therein, and further wherein said insert sheet has no pre-applied indicia thereon in the areas of said insert sheet visible through said cutout window sections of said outer cover sheet and said inner backing sheet when said insert sheet is placed in one of said first and second pockets.

20. A folio system comprising at least one user customizable insert sheet and a folio formed of a first sheet, a second sheet and a third sheet;

wherein the first sheet is attached to said second sheet;

the second sheet having at least one cutout window section therethrough;

the third sheet also having at least one cutout window section therethrough;

the third sheet being formed integrally with one edge of the second sheet to form a common vertical fold line, the third sheet being folded over and in contact with the second sheet and coupled thereto along an edge of the third sheet remote from the second sheet and along a lower edge and an upper edge thereof to thereby form a pocket with an open lateral edge between aid second and third sheets;

wherein said user customizable insert sheet is capable of being imprinted upon by a laser or ink jet printer, and wherein said insert sheet is selectively positionable within said pocket, wherein said insert sheet has no pre-applied indicia thereon in the areas visible through said cutout window sections of said second and third sheets, respectively, when said insert sheet is placed in said pocket.

21. A method of using a cover system for a folio or report that is customizable, by means of a laser or ink jet printer, to include text and/or graphics and/or color of the user's choice, comprising, obtaining an outer cover sheet attached to, or adapted to be attached to a second cover to form a folio, wherein at least one inner backing sheet is affixed along three edges thereof to said outer cover sheet so as to form at least one pocket between said outer cover sheet and said inner backing sheet, and further wherein there is at least one cutout window section in the area of a pocket on each of said outer cover sheet and said inner backing sheet;

obtaining an unbound user customizable insert sheet that is colored and/or textured, or includes at least one area of color and/or texture capable of being imprinted upon by a laser or ink let printer, wherein said area has no pre-applied indicia thereon except said color and/or texture;

imprinting on said user customizable insert sheet, with a laser or ink jet printer, text and/or graphics and/or color of user's choice, in at least one area of said user customizable insert sheet that will be visible through at least one cutout window section in said outer cover sheet or said inner backing sheet when said user customizable insert sheet is placed in said pocket between said outer cover sheet and said inner backing sheet;

placing said unbound user imprinted insert sheet into said pocket between said outer cover sheet and said inner backing sheet to create a folio that has been customized by the user.

* * * * *

UNITED STATES PATENT AND TRADEMARK OFFICE
CERTIFICATE OF CORRECTION

PATENT NO : 5,988,685
DATED : November 23, 1999
INVENTOR(S) : Larry Leibe Mogelonsky and Douglas G. Schwartz It is certified that an error appears in the above-identified patent and that said Letters Patent are hereby corrected as shown below:

At Column 5, line 41, "to provide" should read–is to provide–.

At Column 15, line 12, "where in" should read–wherein–.

At Column 20, line 53, "between aid second" should read --between said second--.

Signed and Sealed this

Twenty-seventh Day of June, 2000

*Attest:*

Q. TODD DICKINSON

*Attesting Officer*

*Director of Patents and Trademarks*